US007534062B2

(12) United States Patent
Ramet

(10) Patent No.: US 7,534,062 B2
(45) Date of Patent: May 19, 2009

(54) KIT COMPRISING TWO RECEPTACLES AND AN APPLICATOR

(75) Inventor: Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 375 days.

(21) Appl. No.: 11/030,883

(22) Filed: Jan. 10, 2005

(65) Prior Publication Data

US 2005/0238408 A1 Oct. 27, 2005

Related U.S. Application Data

(60) Provisional application No. 60/542,863, filed on Feb. 10, 2004.

(30) Foreign Application Priority Data

Jan. 20, 2004 (FR) ..... 04 50104

(51) Int. Cl.
*A46B 11/00* (2006.01)
*A46B 11/06* (2006.01)

(52) U.S. Cl. ..... 401/126; 401/183; 401/40; 401/42

(58) Field of Classification Search ..... 401/126–130, 401/18, 89, 183, 185, 40–43; 141/98; 132/74.5
See application file for complete search history.

(56) References Cited

U.S. PATENT DOCUMENTS

| | | | | |
|---|---|---|---|---|
| 2,877,810 | A * | 3/1959 | Zackheim | 141/24 |
| 2,926,374 | A | 3/1960 | Adler | |
| 3,178,755 | A | 4/1965 | Kormann | |
| 3,786,820 | A * | 1/1974 | Kopfer | 132/74.5 |
| 3,820,576 | A * | 6/1974 | Torrent | 141/24 |
| 3,917,063 | A * | 11/1975 | Chibert et al. | 206/221 |
| 4,573,506 | A | 3/1986 | Paoletti | |
| 4,690,579 | A | 9/1987 | Tuckman | |
| 4,986,322 | A * | 1/1991 | Chibret et al. | 141/319 |
| 5,027,872 | A * | 7/1991 | Taylor et al. | 141/347 |
| 5,307,847 | A | 5/1994 | Pavenick et al. | |
| 5,345,981 | A | 9/1994 | Pavenick et al. | |
| 5,540,654 | A | 7/1996 | Riviere et al. | |
| 5,931,594 | A * | 8/1999 | Garcia | 401/126 |
| 6,237,649 | B1 * | 5/2001 | Moisio et al. | 141/100 |
| 6,302,607 | B1 * | 10/2001 | Burrowes et al. | 401/18 |
| 6,616,366 | B1 * | 9/2003 | Weihrauch | 401/286 |
| 2004/0237986 | A1 * | 12/2004 | Kim | 132/74.5 |
| 2006/0207622 | A1 * | 9/2006 | Gueret | 132/74.5 |

FOREIGN PATENT DOCUMENTS

| | | | |
|---|---|---|---|
| FR | 1 043 061 | A | 11/1953 |
| GB | 7071 | | 3/1890 |
| JP | 2002-179118 | A | 6/2002 |
| WO | WP 03/059118 | A1 | 7/2003 |

* cited by examiner

*Primary Examiner*—David J Walczak
(74) *Attorney, Agent, or Firm*—Oliff & Berridge, PLC

(57) ABSTRACT

A packaging and applicator kit may include: a first receptacle containing a first substance; a second receptacle containing a second substance that is different from the first substance; and, an applicator to which both receptacles can be secured. The applicator may include at least an elongate portion that is capable of extending in one of the first and second receptacles and includes a through channel enabling the substance contained in one of the first and second receptacles to flow for mixing with the substance contained in the other of the first and second receptacles.

33 Claims, 4 Drawing Sheets

KIT COMPRISING TWO RECEPTACLES AND AN APPLICATOR

BACKGROUND

This non provisional application claims the benefit of French Application No. 04 50104 filed on Jan. 20, 2004 and U.S. Provisional Application No. 60/542,863 filed on Feb. 10, 2004, the entire disclosures of which are incorporated by reference herein.

The present invention relates to packaging and applicator devices, for packaging and applying a liquid, such as, for example, a hair coloring substance, which results from mixing first and second separately-packaged substances.

Japanese patent application No. 2002-179118 describes a packaging and applicator device comprising an applicator and a receptacle in which a stopper is disposed separating two compartments for storing two substances for mixing together extemporaneously. The stopper may be moved from a closing position while the two substances are being mixed. Such a device is relatively complex in structure.

U.S. Pat. Nos. 4,573,506 and 5,540,654 describe other devices for separately packaging two substances for mixing together extemporaneously. Those devices are not designed for a cosmetic use of the mixture, such as, for example, by applying the mixture to the hair.

Existing packaging and applicator devices are described in GB patent No. 7071, and U.S. Pat. Nos. 2,926,374, 3,178,755, 4,690,579 and 5,345,981. Each of said devices comprise a receptacle that contains the supply of a substance for application and an applicator provided with an inside channel that communicates with a secondary reservoir enabling the substance to be drawn from the receptacle.

SUMMARY

Such devices enable the applicator to last longer in use, but they are not suitable for packaging two substances for mixing together extemporaneously.

There is a need to benefit from a packaging and applicator device that enables two substances to be packaged separately and to be mixed together extemporaneously, and the resulting mixture to be applied by an applicator, for example, an applicator configured for applying the mixture to the hair.

Exemplary embodiments of the invention provide a packaging and applicator kit comprising: a first receptacle containing a first substance; a second receptacle containing a second substance that is different from the first substance; an applicator to which both the first and second receptacles can be secured, said applicator comprising at least an elongate portion, said elongate portion being capable of extending in one of the first and second receptacles and including a through channel enabling the substance contained in the one of the first and second receptacles to flow for mixing with the substance contained in the other of the first and second receptacles.

Exemplary embodiments of the invention may enable the unit formed by the applicator and only one of the first and second receptacles to be used for applying the mixture. Thus, the unit may weigh less than the whole kit. Moreover, the kit may be comparatively simple to manufacture and to use.

For example, the first substance may be a fluid, such as, for example, a hair dye. The first substance may even be a powder, for example.

The second substance may also be a fluid, such as, for example, a hair coloring oxidant.

The receptacle that is designed to be connected to the applicator during application may comprise a wall that is flexible and elastically-deformable. This may enable a user to squeeze that receptacle in order to expel the mixture contained therein, or in order to suck in the mixture between two utilizations.

Where appropriate, both receptacles may include respective walls that are flexible and elastically-deformable.

Depending on the intended use, the applicator may be made in various shapes. For example, when the first and second substances are designed to be used for treating hair, the applicator may include an applicator portion comprising at least one projection, such as, for example, a succession of teeth or bristles.

The channel of the applicator may open out at one end of the elongate portion.

In exemplary embodiments, said channel may open out, alternatively or additionally, through at least one side hole of the applicator portion. The side hole may be situated between two teeth or two bristles, for example, when the applicator portion includes at least one succession of teeth or bristles, for example, that enable the hair to be combed.

In exemplary embodiments, the applicator may include at least one sealing member configured to be pressed in a leaktight manner against at least one of the receptacles.

In exemplary embodiments, at least one of the receptacles may include a neck. In such embodiments, the applicator may have at least one sealing lip arranged in such a manner as to be pressed against a radially inner surface of said neck.

It may be desirable for air to be able to escape from the receptacle inside which the elongate portion extends, in order to make it easier for the substance contained in the other receptacle to flow. Thus, in exemplary embodiments, the applicator may be fastened to the receptacle in which the elongate portion extends, in a manner that is not airtight.

Where appropriate, in exemplary embodiments, the applicator may include a sealing surface comprising a part of the elongate portion of the applicator. For example, the part may be arranged so that the part can be pressed against an inside surface of the receptacle inside which the elongate portion extends.

In exemplary embodiments, the applicator may include both a first tubular skirt with an inside thread and arranged to receive the first receptacle, and a second tubular skirt with an inside thread and arranged to receive the second receptacle.

In exemplary embodiments, the channel of the applicator, through which the substance contained in one of the receptacles can reach the other receptacle, may include an inside section that is small enough to avoid said substance from leaking out when the unit constituted by the applicator and one of the receptacles is not yet assembled on the other receptacle.

In exemplary embodiments, before being used for the first time, the applicator may have a breakable membrane that closes the channel at one end.

Either independently of in conjunction with the above, exemplary embodiments of the invention may provide a packaging and applicator kit comprising: a first receptacle; a second receptacle; an applicator arranged to be fastened to the first and second receptacles, said applicator including a channel that enables a first substance contained in one of the first and second receptacles to be mixed together with a second substance contained in the other of the first and second receptacles; and at least one stopper arranged to close the first receptacle and the second receptacle in a leaktight manner, when the applicator is not fastened to at least one of the first and second receptacles.

Either independently of or in conjunction with the above, exemplary embodiments of the invention may provide a packaging and applicator kit comprising: a first receptacle; a second receptacle; an applicator arranged to be fastened to both the first and second receptacles in order to establish communication between the first and second receptacles, said applicator including at least a succession of projections on an outer periphery thereof. The projections may be, for example, molded integrally, i.e., monolithically, with the applicator. For example, at least one succession of teeth or bristles may be molded monolithically with the applicator.

Exemplary embodiments of the invention may provide a packaging and applicator kit comprising: a first receptacle closed by a removable stopper; a second receptacle; an applicator that is secured to the second receptacle, said applicator including a channel that is closed at one end by a closure arranged to move from a closed configuration to an open configuration, thereby enabling the first and second receptacles to communicate with each other, in response to an action exerted by a user.

In exemplary embodiments, the closure may be configured so as to change configuration by bearing against a bottom of the first receptacle when the applicator is engaged therein. In exemplary embodiments, the closure may comprise a spike connected to the elongate portion by a breakable zone. In exemplary embodiments, the closure may be made integrally, i.e., monolithically, with the applicator by molding a plastics material.

BRIEF DESCRIPTION OF THE DRAWINGS

The invention will be better understood on reading the following detailed description of non-limiting embodiments, and on examining the accompanying drawings, in which.

DETAILED DESCRIPTION OF EXEMPLARY EMBODIMENTS

Figure 1:
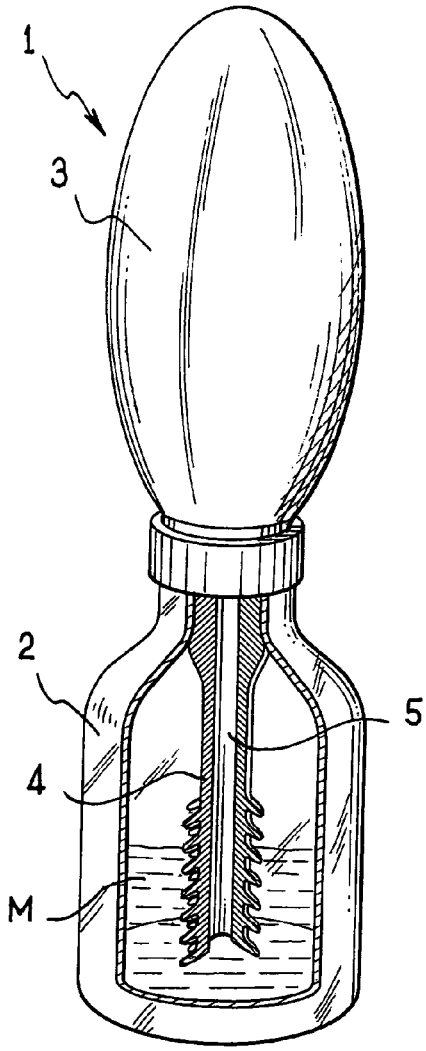
FIG. 1 is a partially cut-away perspective view of an exemplary packaging and applicator device.
Figure 2:
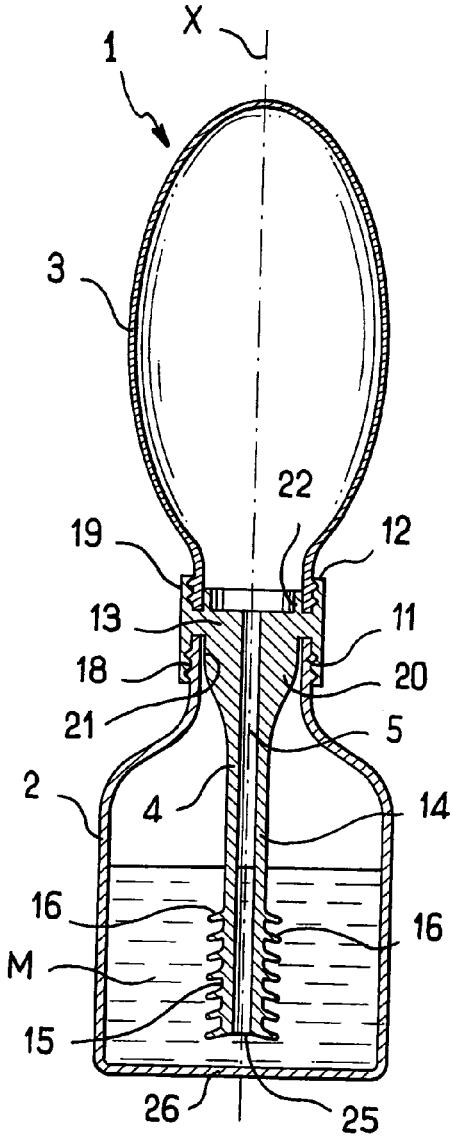
FIG. 2 is a diagrammatic longitudinal cross-section view of the device of FIG. 1.

An exemplary packaging and applicator device 1 shown in FIGS. 1 and 2 may comprise a first receptacle 2; a second receptacle 3 superimposed on the first receptacle along a longitudinal axis X; and an applicator 4 that includes an inside channel 5 which allows for communication between the two receptacles 2 and 3.

Figure 4:
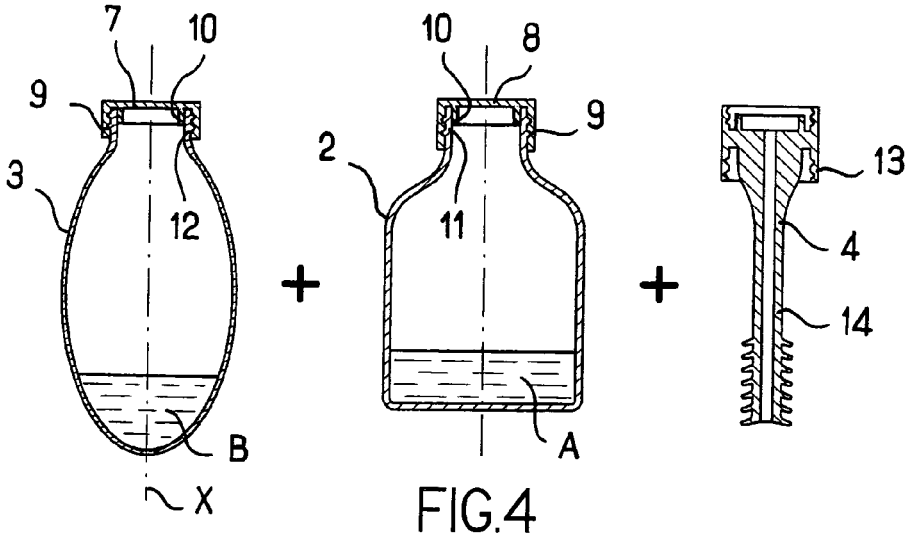
FIG. 4 is a diagrammatic cross-section view of an example of a packaging and applicator kit.

The device 1 may be obtained by assembling an exemplary kit as shown in FIG. 4, in which the first receptacle 2, which may contain a first substance A, and may be closed by an individual stopper 8. The second receptacle 3, which may contain a second substance B, may also be closed by an individual stopper 7. Initially, the applicator 4 may be separate from the receptacles 2 and 3, as shown in FIG. 4.

Each of the individual stoppers 7 and 8 may include an internally threaded assembly skirt 9 and a sealing lip 10. The sealing lip 10 of the stopper 8 may be arranged to press in a leaktight manner against a radially inner surface of a neck 11 of the first receptacle 2, and the sealing lip 10 of the stopper 7 may be arranged to press in a leaktight manner against a radially inner surface of a neck 12 of the second receptacle 3.

For example, the substance A may be an oxidizing coloring agent and the substance B may be a coloring agent designed to be mixed with substance A when said substances are used.

The second receptacle 3 may include a wall that is flexible and elastically-deformable which a user can squeeze in order to reduce an inside volume thereof.

The applicator 4 may include an elongate portion 14 of axis X, provided at a top end thereof with an enlarged portion 20 that connects to a coupling portion 13, which coupling portion may serve to secure the receptacles 2 and 3 to each other. At a bottom end thereof, the elongate portion 14 may include an applicator portion 15. As shown, said applicator portion 15 may include, for example, projections 16 made integrally, i.e., monolithically, with the elongate portion 14. The projections 16 may comprise a succession of teeth, for example. The applicator 4 may also have a length that allows the applicator portion 15 to extend into the first substance A in the first receptacle 2.

The coupling portion 13 may include both a first tubular skirt 18 of axis X, that is internally threaded and arranged to be screwed onto the neck 11 of the first receptacle 2, and a second tubular skirt 19 of axis X arranged to be screwed onto the neck 12 of the second receptacle 3, in a like manner.

Where appropriate, the skirts 18 and 19 may have different inside diameters in order to avoid any risk of the receptacles 2 and 3 being assembled to the device 1 in a reversed or incorrect way. The coupling portion 13 may also include sealing means for ensuring that the coupling portion 13 is fastened to the receptacle 3 in a leaktight manner.

As shown in the exemplary embodiment, said sealing means may comprise an annular sealing lip 22 arranged to be pressed against an inside surface of the neck 12.

Alternatively, an outside surface 21 of the enlarged portion may be pressed against the under surface of the neck 11 in a leaktight manner.

As shown in the exemplary embodiment, the channel 5 may open out at a bottom of the elongate portion 14 through an orifice 25 that may be situated quite close to the bottom 26 of the first receptacle 2, for example, as shown in FIG. 2.

In order to mix the substances A and B together, the user may proceed as follows.

Figure 5:
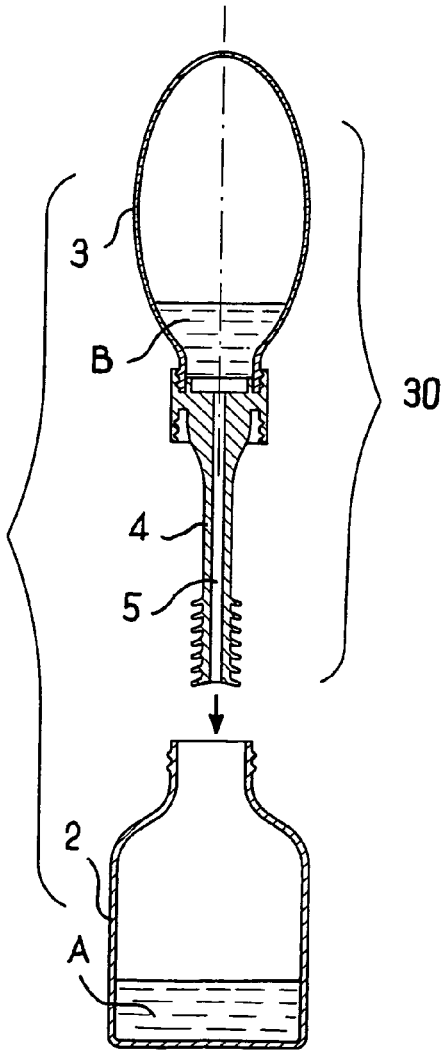
FIG. 5 illustrates how the kit of FIG. 4 kit may be used.

The user may remove the stoppers 7 and 8, then screw the applicator 4 onto the second receptacle 3, and lastly introduce the unit 30 formed by the applicator 4 and the second receptacle 3 into the first receptacle 2, as shown in FIG. 5.

The section of the channel 5 may be small enough to avoid any major leakage of the substance A during this operation, and better still to avoid any outflow at all.

The user may then squeeze the flexible wall of the receptacle 3 one or several times in order to expel the substance A contained inside the first receptacle 2 and shake up the mixture thereby obtained. Each time the user ceases to exert pressure on the wall of the second receptacle 3, said wall may return elastically to its initial shape. The presence of the projections 16 may contribute to making the mixture M homogeneous under the effect of turbulence created in the first receptacle 2 by the variation of the volume inside the second receptacle 3. That the skirt 18 may be secured to the neck 11 in a manner that is not totally airtight, and an air gap may exist between the enlarged portion 20 and the neck 11, may make it easier for the air contained in the receptacle 2 to be expelled when said receptacle 2 is filled with the substance contained in the receptacle 3.

Figure 3:
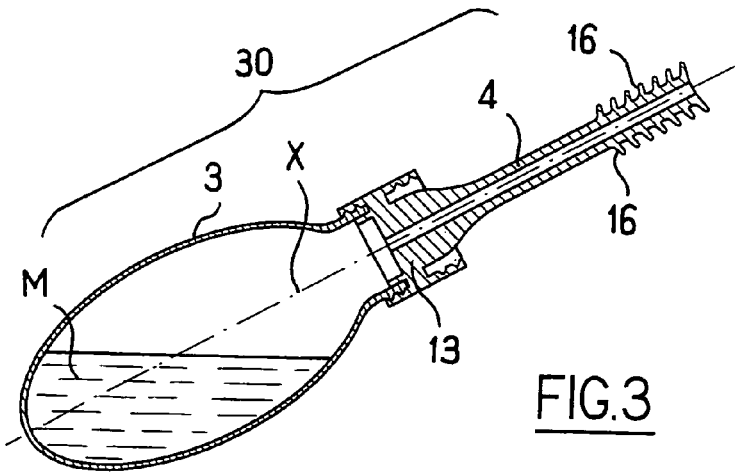
FIG. 3 is a longitudinal cross-section view of an exemplary unit, including the applicator and one receptacle, which serves as a handle member.

The mixture M may be dispensed by separating the unit 30 from the first receptacle 2 again, as shown in FIG. 3. The receptacle 3 then serves as a handle member. The mixture M may be applied, for example, to the hair by squeezing on the wall of the second receptacle 3, and the projections 16 may be used to spread the substance all over the hair, since individual hairs may become engaged in said projections.

It should be understood that the invention is not limited to the exemplary embodiment described above, and various modifications may be made to the receptacles, and also to the applicator.

Figure 6:
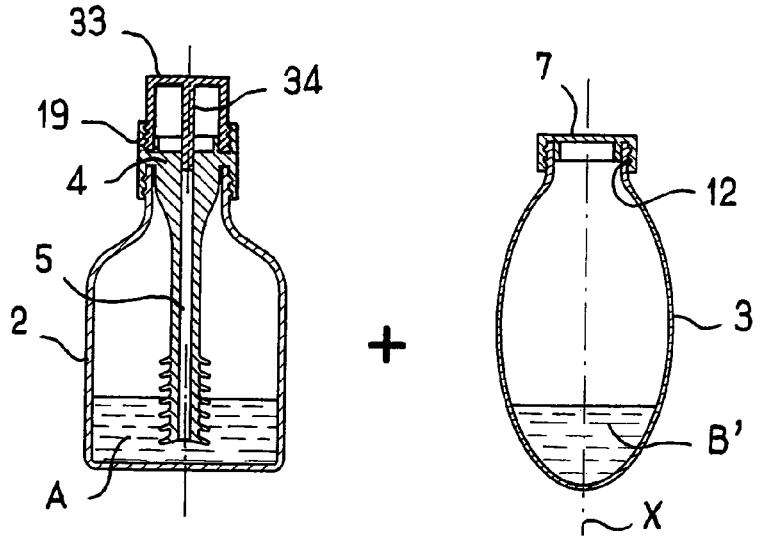
FIGS. 6 to 8 show three additional exemplary kits.

For example, as shown in FIG. 6, an exemplary kit may include a stopper 33 arranged to be secured to the skirt 19 of the applicator 4, said applicator being already in place on the first receptacle 2 when made available to the user. The stopper 33 may include a central plug 34 arranged to close the channel 5 of the applicator. In order to mix the substances A and B together, the user may remove the stoppers 7 and 33, for example, and then screw the skirt 19 onto the neck 12 of the second receptacle 3.

Figure 7:
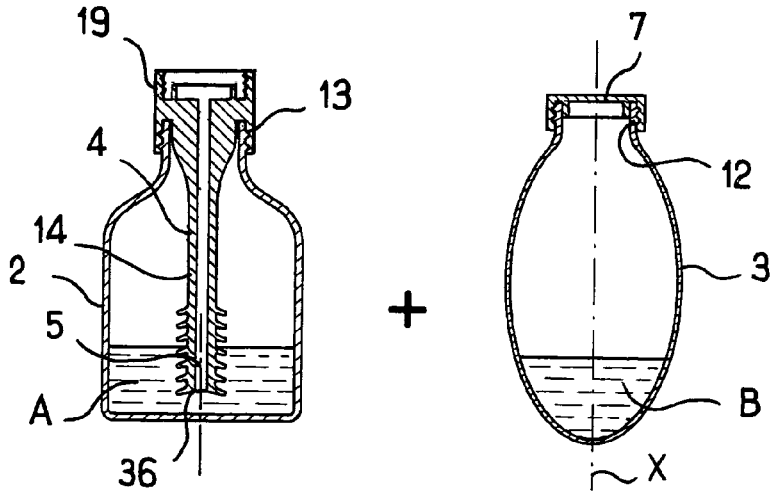

As shown in FIG. 7, an exemplary kit may also include a plug 36 secured to the end of the elongate portion 14 of the applicator 4 so as to close the channel 5. As in the example above, the applicator 4 may already be in place on the first receptacle 2 when made available to the user. In order to mix the substances A and B together, the user may remove the stopper 7 and screw the skirt 19 onto the neck 12 of the second receptacle 3. During said operation, the plug 36 is still in place at the end of the applicator 4, which prevents any risk of the substance A flowing out from the first receptacle 2. Once the second receptacle is assembled on the coupling portion 13, the user may squeeze the wall of the second receptacle 3 in order to expel the plug 36 and allow the substances A and B to be mixed together.

Figure 8:
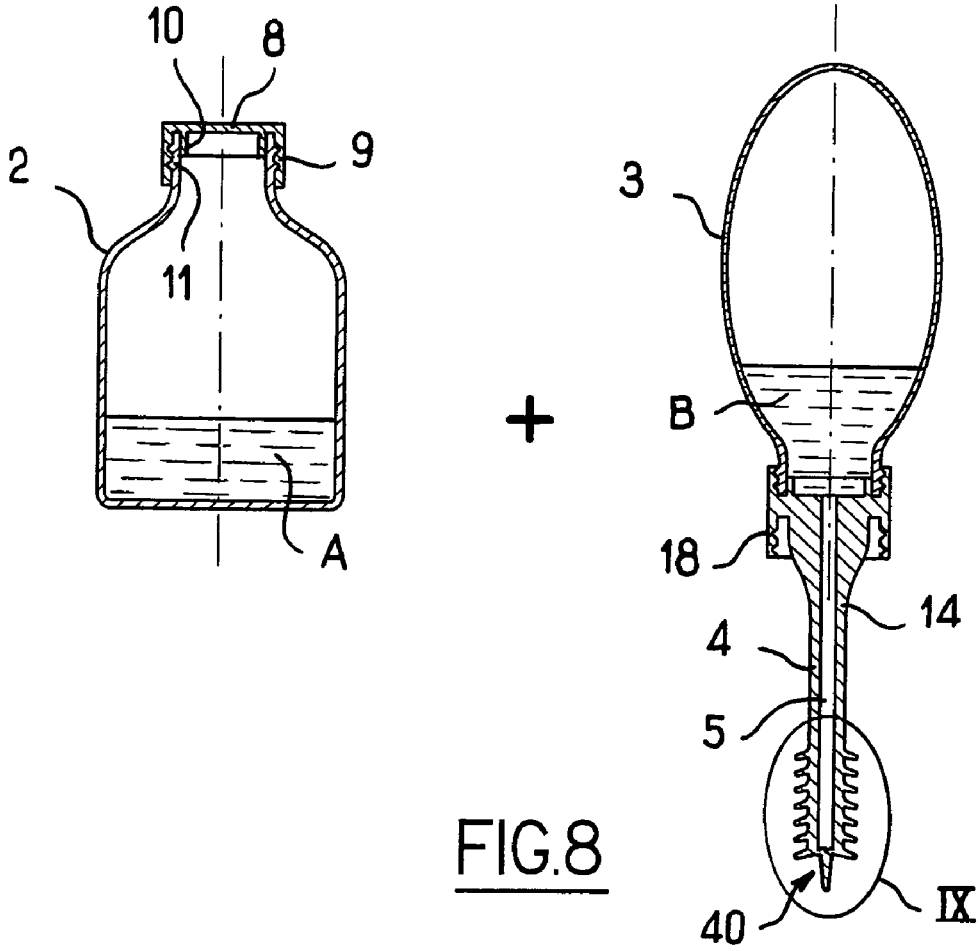
Figure 9:
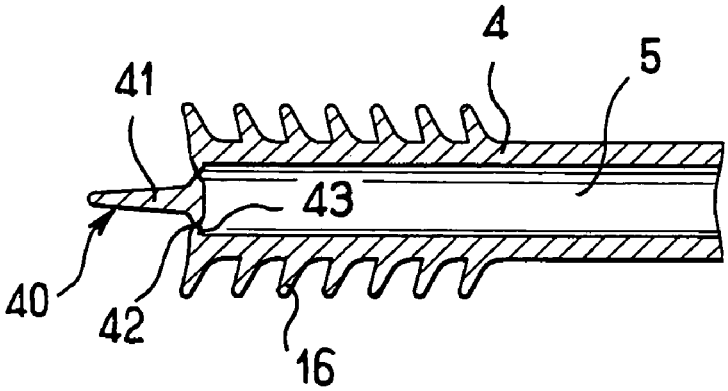
FIG. 9 shows an enlarged view of a detail IX in FIG. 8.

In the exemplary embodiment shown in FIGS. 8 and 9, an exemplary kit comprises the receptacle 2 containing the substance A, said receptacle being closed by the stopper 8, and the receptacle 3 containing the substance B, said receptacle being closed by the applicator 4. The applicator 4 may be provided with a closure 40, shown in detail in FIG. 9.

The closure 40 may comprise a membrane seal that has a spike 21 connected to a collar 43 by an annular zone of weakness 42. The collar 43 may protrude radially inward at one end of the channel 5. Advantageously, the membrane seal may be made integrally, i.e., monolithincally, with the elongate portion 14 of the applicator 4, for example, by molding a plastics material.

Advantageously, as in the exemplary embodiment shown in FIGS. 8 and 9, the closure 40 may be arranged in such a way that they automatically move from a closed configuration to an open configuration, thereby enabling the substance B to be mixed with the substance A, when the elongate portion 14 of the applicator 4 is introduced into the receptacle 2. For example, such a change of configuration may be obtained by the closure 40 cooperating with the bottom of the receptacle 2 into which the applicator 4 is introduced.

In the exemplary embodiment shown in FIGS. 8 and 9, the spike 41 may bear against the bottom of the receptacle 2 before the skirt 18 has been fully screwed onto the neck 11 of the receptacle 2 and before the annular zone of weakness 42 is broken, which, once the applicator 4 has been screwed home, results in the spike 41 moving upwards into the channel 5. This enables the substance B to flow into the channel 5 around the spike 41. Preferably, the diameter of the annular zone 4 is much smaller than the inside diameter of the channel 5.

It should be understood that the closure 40 may be made in an other suitable manner.

Although not shown, the closure 40 may comprise a plug fitted to the elongate portion 14 of the applicator 4 and held onto said elongate portion, for example, by clip-fastening, friction, adhesive, or heat-sealing. For example, the plug may be a membrane seal that is heat sealed to the end of the elongate portion 14 and that the user may remove or pierce before putting the applicator 4 into the receptacle 2. Where appropriate, the bottom of said receptacle 2 may be provided with a spike which perforates the membrane seal.

Figure 10:
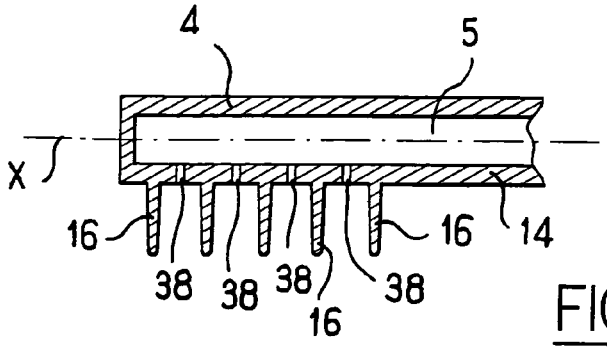
FIG. 10 is a diagrammatic and fragmentary longitudinal cross-section view of an exemplary applicator.

The portion of the applicator that serves to apply the substance may be made in various ways. In the exemplary embodiment shown in FIG. 10, the channel 5 may open out through lateral holes 38 that are situated between the projections 16. For example, said projections may comprise a succession of teeth or bristles, each of said projections extending along an outer periphery of the elongate portion 14. The term "outer periphery" is used to define a region of the elongate portion that extends about the axis X. Each projection 16, for example, each tooth or bristle, may extend in a direction that is substantially perpendicular to the longitudinal axis X.

Where appropriate, all the lateral holes 38 may open out on a same side of the applicator 4. Optionally, the projections 16 need not be made integrally with the elongate portion 14 by molding a material.

Throughout the description, including in the claims, the term "including a" or "comprising a" must be understood as being synonymous with "including at least one" or "comprising at least one", unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A packaging and applicator kit, comprising:

a first receptacle containing a first substance;

a second receptacle containing a second substance that is different from the first substance, the first substance being a liquid or a powder and the second substance being a liquid;

an applicator securable to both the first and second receptacles, said applicator comprising at least an elongate portion, said portion being capable of extending in one of the first and second receptacles and including a through channel enabling the substance contained in one of the first and second receptacles to flow for mixing with the substance contained in the other of the first and second receptacles, the applicator further comprising an applicator portion allowing to treat a surface with a mixture of the first and second substances, the applicator portion comprising at least one projection.

2. A kit according to claim 1, wherein the first substance comprises a liquid.

3. A kit according to claim 1, wherein the first substance comprises a hair dye.

4. A kit according to claim 1, wherein the second substance comprises a hair coloring oxidant.

5. A kit according to claim 1, wherein at least one of the first and second receptacles comprises a flexible and elastically-deformable wall.

6. A kit according to claim 5, wherein the at least one of the first and second receptacles including the flexible and elastically-deformable wall is secured to the applicator during application of the mixture of the first and second substances.

7. A kit according to claim 1, wherein the first and second receptacles each include a flexible and elastically-deformable wall.

8. A kit according to claim 1, wherein the at least one projection comprises a succession of at least one of teeth and bristles.

9. A kit according to claim 1, wherein the through channel opens out at one end of the elongate portion.

10. A kit according to claim 1, wherein the through channel opens out through at least one side hole.

11. A kit according to claim 10, wherein said at least one side hole is situated between at least one of two teeth and two bristles.

12. A kit according to claim 1, wherein the applicator includes at least one sealing member configured to be pressed in a leaktight manner against one of the first and second receptacles.

13. A kit according to claim 12, wherein the applicator is arranged to be secured to the one of the first and second receptacles in which the elongate portion extends, in a manner that is not completely airtight.

14. A kit according to claim 1, wherein the applicator comprises:

a first tubular skirt with an inside thread, the first tubular skirt being arranged to receive the first receptacle; and a second tubular skirt with an inside thread, the second tubular skirt being arranged to receive the second receptacle.

15. A packaging and applicator kit according to claim 1, wherein the at least one projection extends generally orthogonally to a longitudinal axis of the applicator.

16. A packaging and applicator kit, comprising:

a first receptacle containing a first substance;

a second receptacle containing a second substance different from the first substance, the first substance being a liquid or a powder and the second substance being a liquid;

an applicator arranged to be fastened to both of the first and second receptacles, in a removable manner, in order to establish communication between the first and second receptacles, said applicator including at least one succession of projections on an outer periphery thereof in a region of the applicator allowing to treat a surface with a mixture of the first and second substances.

17. A packaging and applicator kit according to claim 16, wherein the projections extend generally orthogonally to a longitudinal axis of the applicator.

18. A packaging and applicator kit, comprising:

a first receptacle containing a first substance;

a second receptacle containing a second substance different from the first substance, the first substance being a liquid or a powder and the second substance being a liquid;

an applicator arranged to be fastened to the first and second receptacles, said applicator comprising a channel that enables the first substance to be mixed with the second substance, the applicator comprising an applicator portion and having a length that allows the applicator portion to extend into the first substance in the first receptacle when the applicator is fastened to the first and second receptacles; and at least one stopper arranged to close the first receptacle and the second receptacle in a leaktight manner when the applicator is not fastened to at least one of the first and second receptacles.

19. A kit according to claim 18, wherein at least one of the first and second receptacles comprises a flexible and elastically-deformable wall.

20. A kit according to claim 19, wherein the at least one of the first and second receptacles including the flexible and elastically-deformable wall is secured to the applicator during application of the mixture of the first and second substances.

21. A kit according to claim 18, wherein the first and second receptacles each include a flexible and elastically-deformable wall.

22. A kit according to claim 18, wherein the applicator includes at least one sealing member configured to be pressed in a leaktight manner against one of the first and second receptacles.

23. A kit according to claim 22, wherein the applicator is arranged to be fastened to one of the first and second receptacles in which an elongate portion including the channel extends, in a manner that is not completely airtight.

24. A kit according to claim 18, wherein the applicator comprises:

a first tubular skirt with an inside thread, the first tubular skirt being arranged to receive the first receptacle; and a second tubular skirt with an inside thread, the second tubular skirt being arranged to receive the second receptacle.

25. A packaging and applicator kit, comprising:

a first receptacle containing a first substance;

a second receptacle containing a second substance different from the first substance, the first substance being a liquid or a powder and the second substance being a liquid;

an applicator arranged to be fastened to both the first and second receptacles in order to establish communication between the first and second receptacles, said applicator comprising at least one succession of projections on an outer periphery thereof on a region of the applicator allowing to treat a surface with a mixture of the first and second substances, the projections being molded monolithically with the applicator.

26. A kit according to claim 25, wherein the at least one succession of projections comprises at least one succession of at least one of teeth and bristles.

27. A kit according to claim 25, wherein at least one of the first and second receptacles comprises a flexible and elastically-deformable wall.

28. A kit according to claim 27, wherein the at least one of the first and second receptacles including the flexible and elastically-deformable wall is secured to the applicator during application of the mixture of the first and second substances.

29. A kit according to claim 25, wherein the first and second receptacles each include a flexible and elastically-deformable wall.

30. A kit according to claim 25, wherein the applicator includes at least one sealing member configured to be pressed in a leaktight manner against one of the first and second receptacles.

31. A kit according to claim 30, wherein the applicator is arranged to be fastened to the one of the first and second receptacles in which an elongate portion extends, in a manner that is not completely airtight.

32. A kit according to claim 25, wherein the applicator comprises:

a first tubular skirt with an inside thread, the first tubular skirt being arranged to receive the first receptacle; and a second tubular skirt with an inside thread, the second tubular skirt being arranged to receive the second receptacle.

33. A packaging and applicator kit according to claim 25, wherein the projections extend generally orthogonally to a longitudinal axis of the applicator.

* * * * *